US010744764B2

(12) United States Patent
Massucci

(10) Patent No.: US 10,744,764 B2
(45) Date of Patent: Aug. 18, 2020

(54) DROPLET DEPOSITION APPARATUS

(71) Applicant: Xaar Technology Limited, Cambridge (GB)

(72) Inventor: Mario Massucci, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/314,268

(22) PCT Filed: Jun. 29, 2017

(86) PCT No.: PCT/GB2017/051906
§ 371 (c)(1),
(2) Date: Dec. 28, 2018

(87) PCT Pub. No.: WO2018/002630
PCT Pub. Date: Jan. 4, 2018

(65) Prior Publication Data

US 2019/0224967 A1 Jul. 25, 2019

(30) Foreign Application Priority Data

Jun. 30, 2016 (GB) ..... 1611489.4

(51) Int. Cl.
*B41J 2/045* (2006.01)

(52) U.S. Cl.
CPC ..... *B41J 2/04588* (2013.01); *B41J 2/04581* (2013.01); *B41J 2/04596* (2013.01)

(58) Field of Classification Search
CPC ..... B41J 2/04581; B41J 2/04588; B41J 2/04541; B41J 2/04596; B41J 2/04543; B41J 2/04501
See application file for complete search history.

(56) References Cited

U.S. PATENT DOCUMENTS

| | | | | |
|---|---|---|---|---|
| 5,736,994 | A | 4/1998 | Takahashi | |
| 6,099,103 | A | 8/2000 | Takahashi | |
| 9,340,012 | B2 * | 5/2016 | Araki | B41J 2/04588 |
| 2005/0212840 | A1 | 9/2005 | Iriguchi | |
| 2011/0175956 | A1 * | 7/2011 | Tsukamoto | B41J 2/04588 347/10 |
| 2012/0081431 | A1 | 4/2012 | Yamashita | |

(Continued)

FOREIGN PATENT DOCUMENTS

| | | |
|---|---|---|
| CN | 1480329 | 3/2004 |
| CN | 102089150 | 6/2011 |

(Continued)

OTHER PUBLICATIONS

International Search Report and Written Opinion dated Oct. 2, 2017, in International Application No. PCT/GB2017/051906 (8 pages.).

(Continued)

*Primary Examiner* — Jannelle M Lebron
(74) *Attorney, Agent, or Firm* — Finnegan, Henderson, Farabow, Garrett & Dunner LLP

(57) ABSTRACT

A circuit or a droplet deposition apparatus, the circuit configured to generate a drive waveform having a drive pulse, a first non-ejection pulse and a second non-ejection pulse, and wherein the first non-ejection pulse is inverted with respect to the second non-ejection pulse.

20 Claims, 11 Drawing Sheets

(56) References Cited

U.S. PATENT DOCUMENTS

Figure 1:
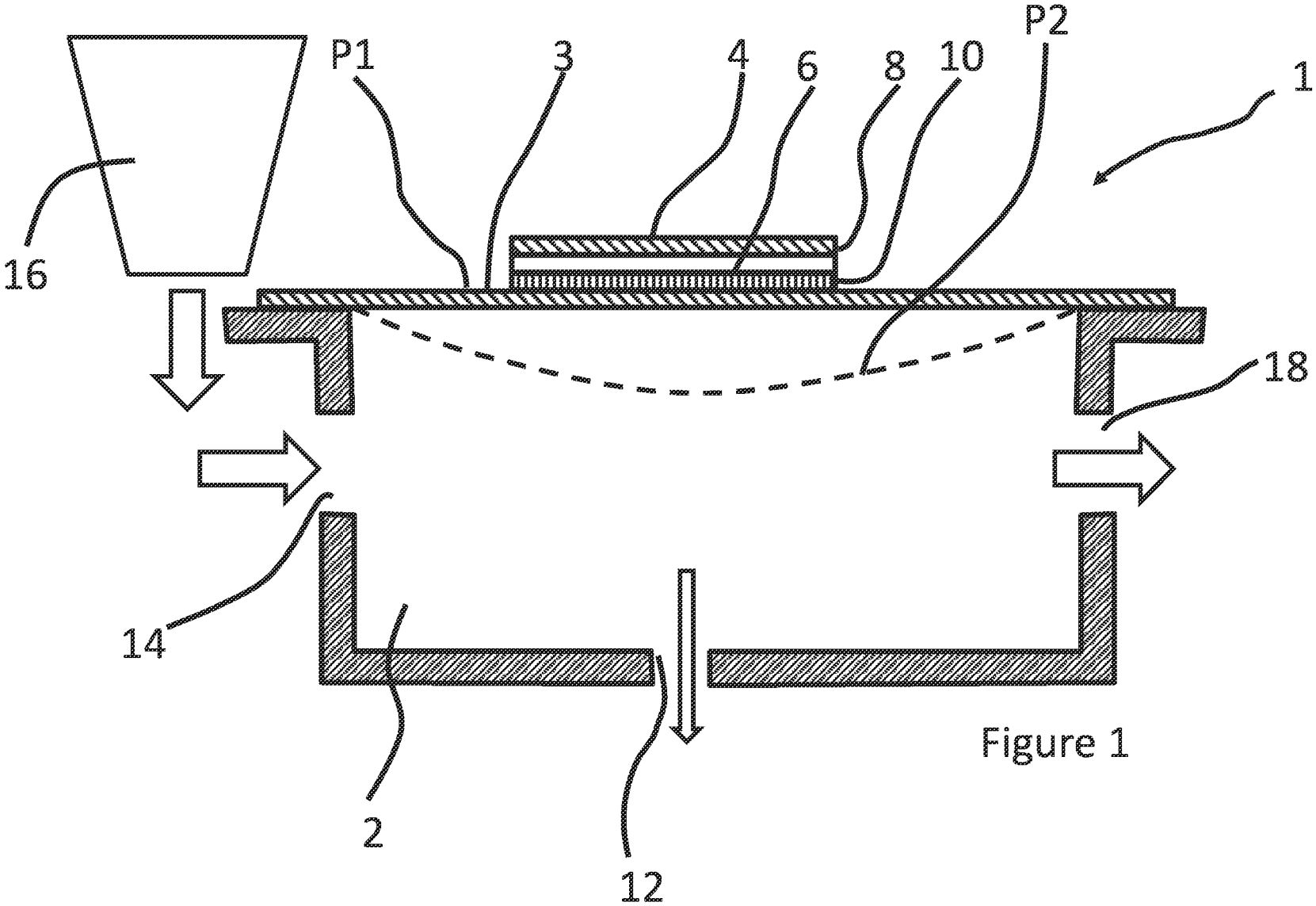

| | | | |
|---|---|---|---|
| 2013/0063508 | A1 | 3/2013 | Norigoe |
| 2013/0083107 | A1 | 4/2013 | Nishikawa et al. |
| 2014/0125722 | A1 | 8/2014 | Otokita |
| 2015/0197085 | A1 | 7/2015 | Panchawagh et al. |

FOREIGN PATENT DOCUMENTS

| | | | |
|---|---|---|---|
| CN | 104417059 | | 3/2015 |
| CN | 105451999 | | 3/2016 |
| EP | 1 531 049 | A2 | 5/2005 |
| EP | 2072259 | A1 | 6/2009 |
| JP | 2014208411 | A | 11/2014 |
| WO | WO 95/25011 | A1 | 9/1995 |

OTHER PUBLICATIONS

First Chinese Office Action dated May 20, 2020, in Chinese Application No. 201780041163.6 (9 pgs.) and machine translation (10 pgs.).

* cited by examiner 20
(V)
VDRIVE
VREST
22
Vm
PW
(t)

3
3
3
(ii)
(iii)
(iiii)

DROPLET DEPOSITION APPARATUS

This application is a National Stage Entry of International Application No. PCT/GB2017/051906, filed Jun. 29, 2017, which is based on and claims the benefit of foreign priority under 35 U.S.C. § 119 to GB Application No. 1611489.4, filed Jun. 30, 2016. The entire contents of the above-referenced applications are expressly incorporated herein by reference.

The present invention relates to a droplet deposition apparatus. It may find particularly beneficial application in a printer, such as an inkjet printer.

Droplet deposition apparatuses, such as inkjet printers are known to provide controlled ejection of droplets from a droplet deposition head, and to provide for controlled placement of such droplets to create dots on a receiving or print medium.

Droplet deposition heads, such as inkjet printheads generally comprise one or more pressure chambers each having associated ejection mechanisms in the form of actuator elements.

The actuator elements are configured to deform in a controlled manner in response to a signal, e.g. a waveform comprising one or more drive pulses, thereby causing droplets to be generated and ejected from nozzles associated with the respective one or more pressure chambers. The actuator elements may be provided in different configurations depending on the specific application. For example, the actuator elements may be provided in roof mode or shared wall configurations.

Embodiments may provide improved droplet deposition apparatuses, droplet deposition heads, or methods of driving such heads.

According to a first aspect, there is provided a drive circuit for a droplet deposition apparatus, the drive circuit configured to generate a drive waveform having a drive pulse, a first non-ejection pulse and a second non-ejection pulse, and wherein the first non-ejection pulse is inverted with respect to the second non-ejection pulse.

According to a second aspect, there is provided a method of driving an actuator element with a drive waveform to eject droplets from an associated pressure chamber, the method comprising: applying a drive pulse to the actuator element; applying a first non-ejection pulse to the actuator element; applying a second non-ejection pulse to the actuator element, wherein the second non-ejection pulse is inverted with respect to the first non-ejection pulse.

Figures 2A, 2B:
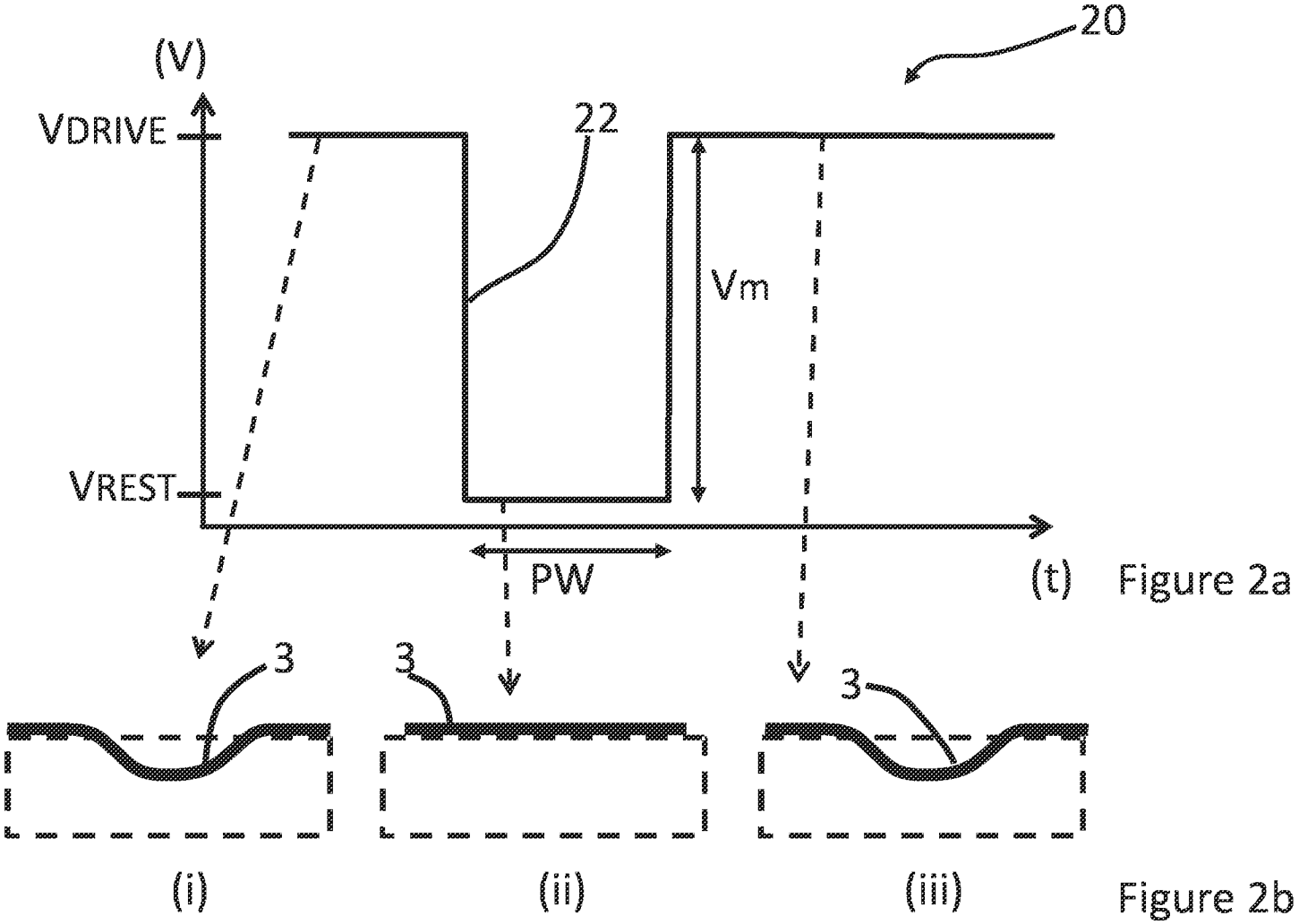
Figure 3A:
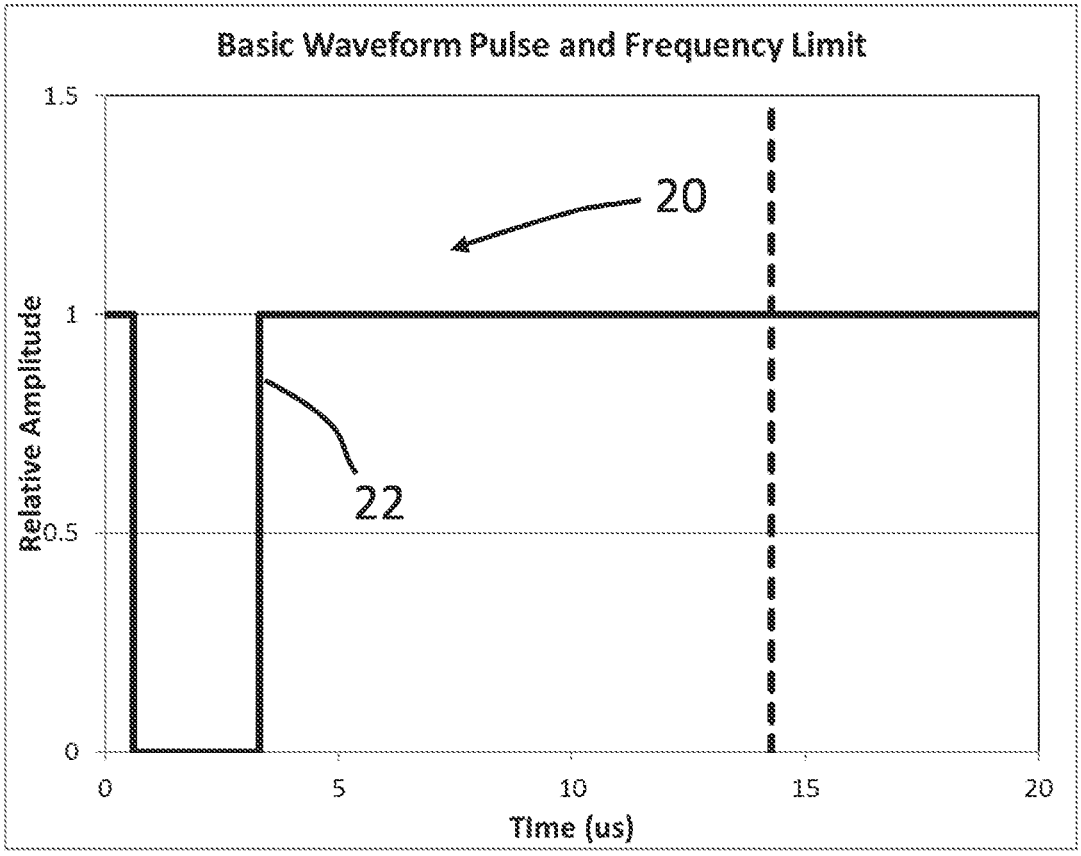
Figure 3B:
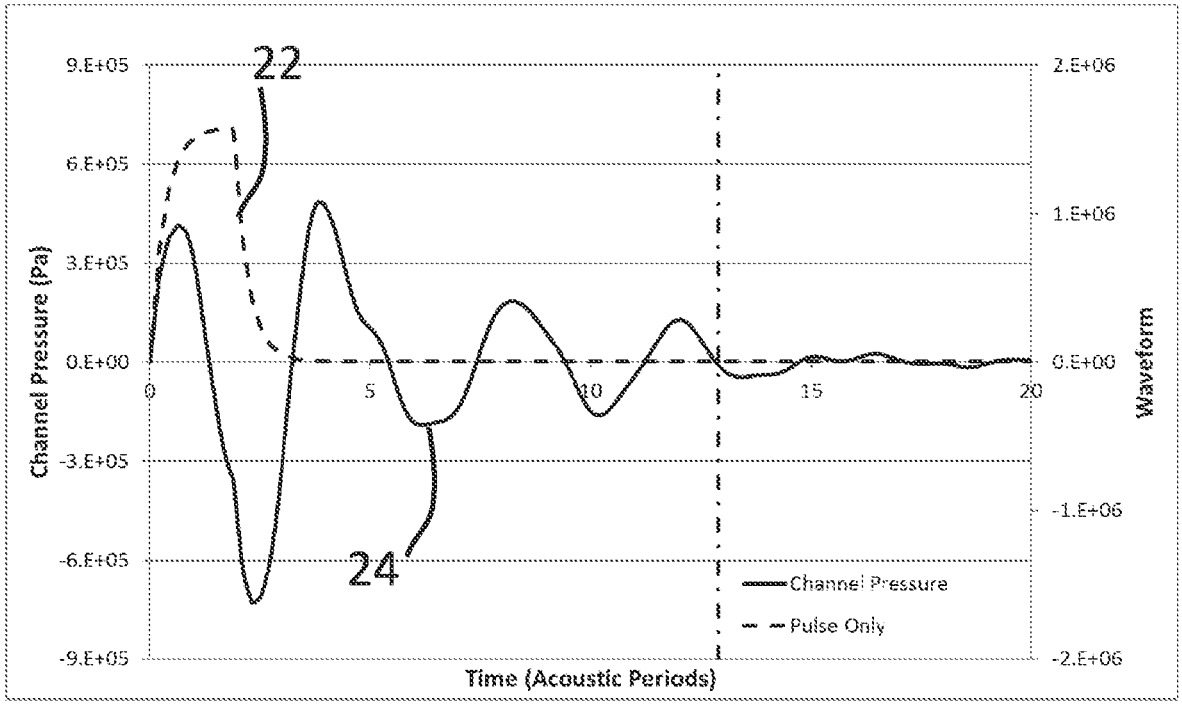
Figure 3C:
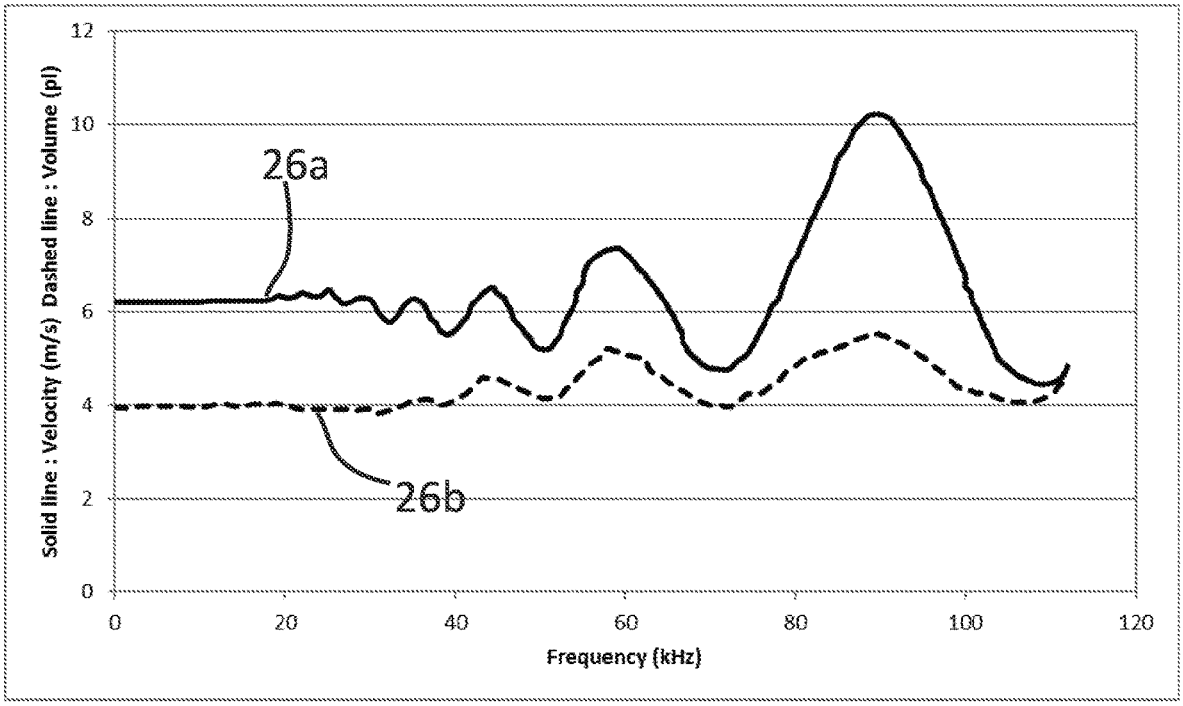

Embodiments will now be described with reference to the accompanying figures of which:

FIG. 1 schematically shows a cross section of a part of a droplet deposition head according to an embodiment;

FIG. 2*a* schematically shows an example of a known drive waveform having a single drive pulse;

FIG. 2*b* schematically shows, by example only, the effect the drive pulse of FIG. 2*a* has on a membrane when applied to an actuator element associated with the membrane;

FIG. 3*a* schematically shows a representation of the drive waveform of FIG. 2*a* when applied to an actuator element;

FIG. 3*b* schematically graphically shows a signal resulting from the waveform of FIG. 3*a* at an actuator element, superimposed in time on the measured pressure in an associated pressure chamber in response to the actual signal;

FIG. 3*c* graphically represents the result of driving a droplet deposition head with the waveform in FIG. 3*a;*

Figure 4:
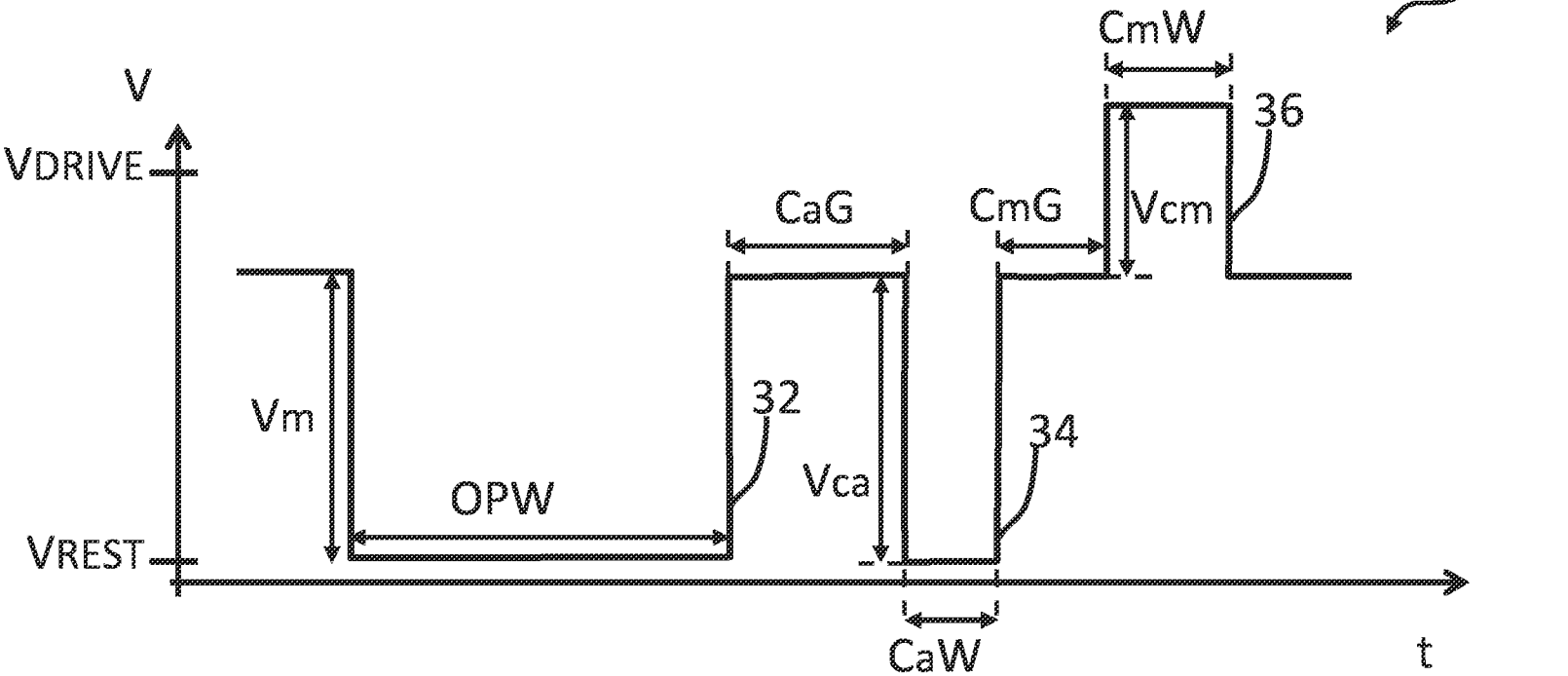
Figure 5A:
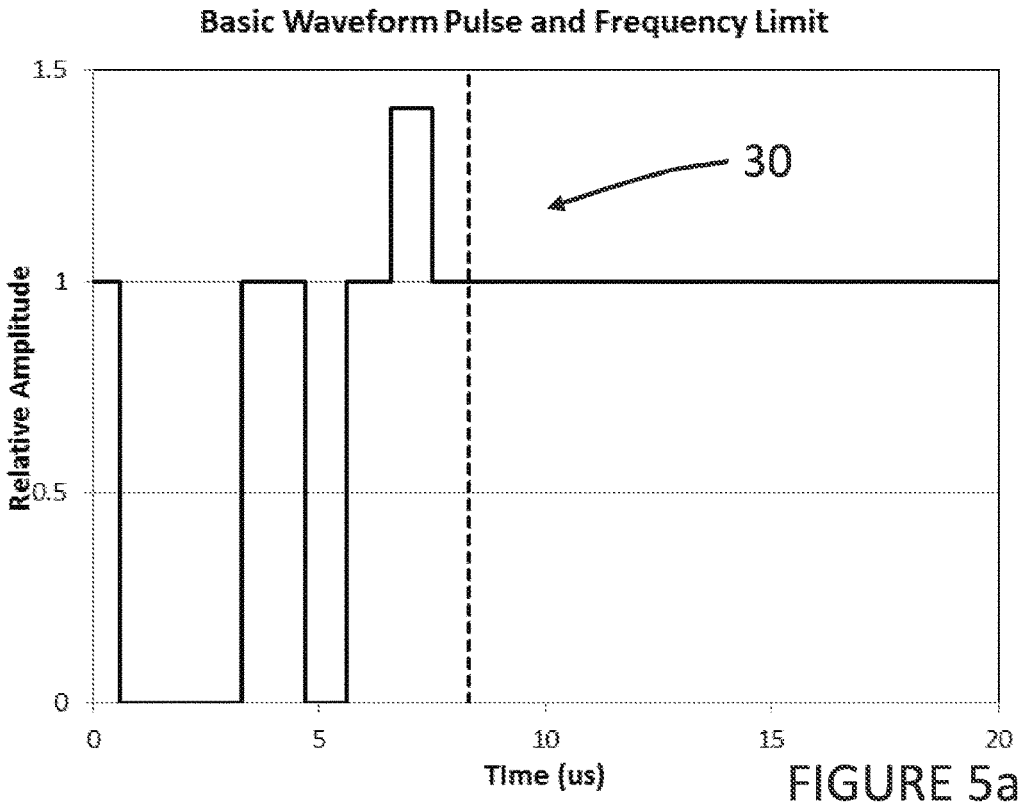
Figure 5B:
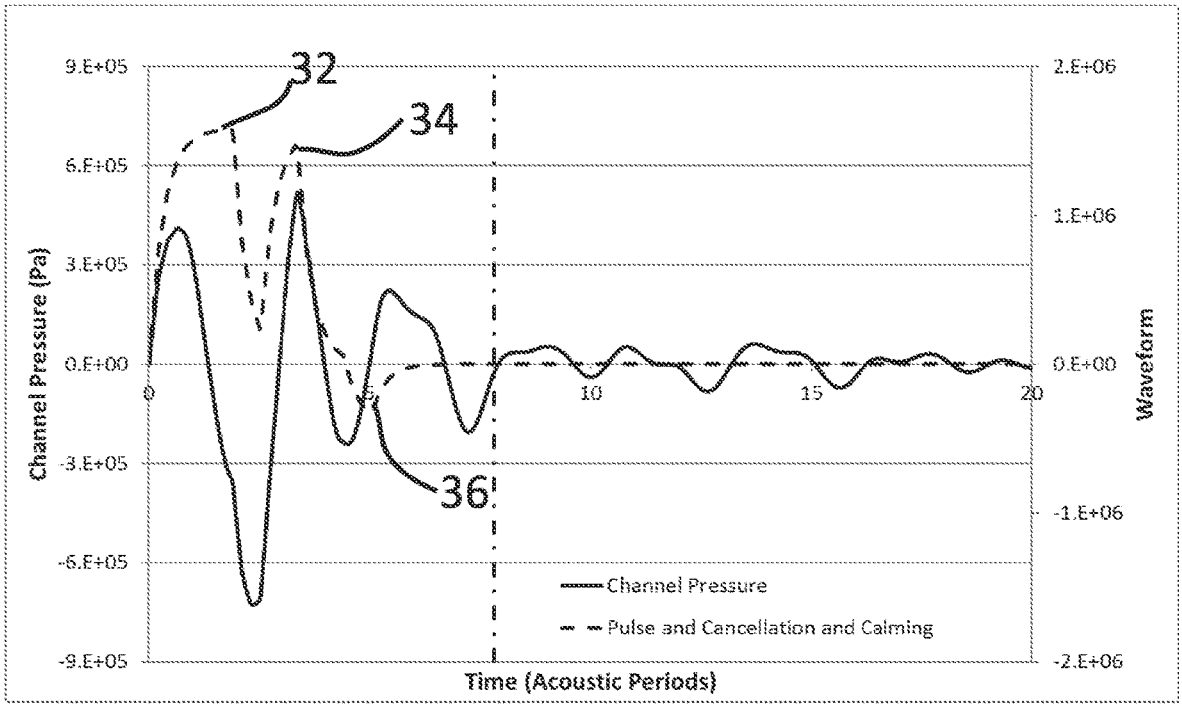
Figure 5C:
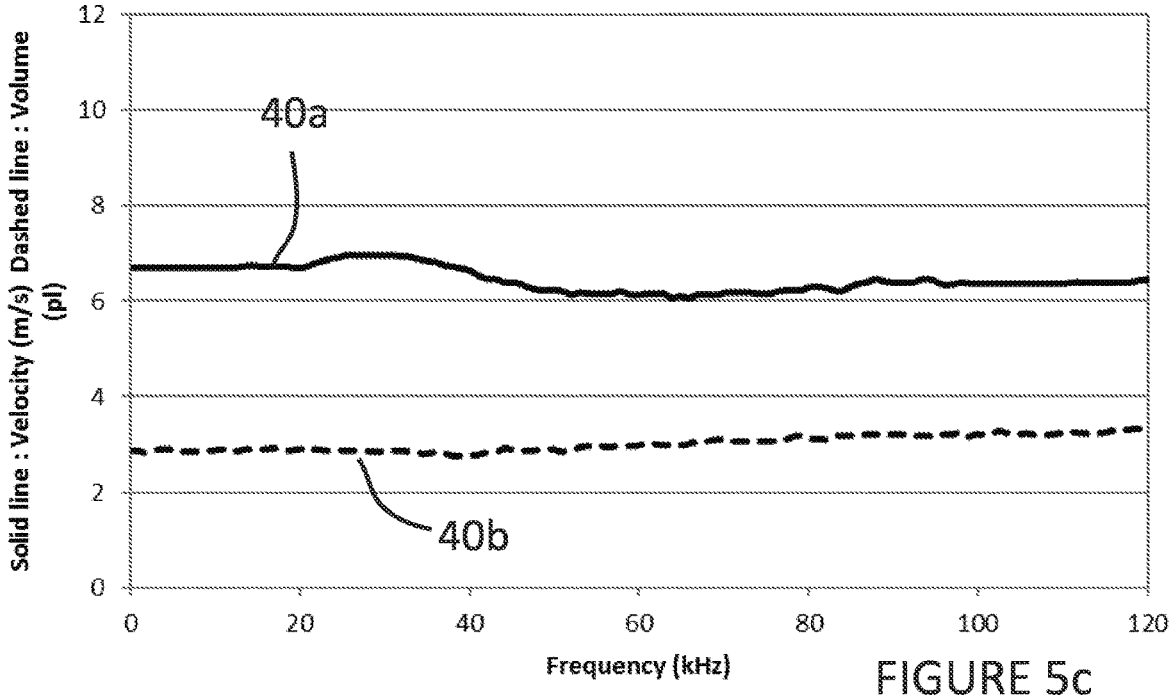

FIG. 4 schematically shows a drive waveform according to an embodiment;

FIG. 5*a* schematically shows a representation of the drive waveform of FIG. 4 when applied to an actuator element according to an embodiment;

FIG. 5*b* graphically shows a signal resulting from the waveform of FIG. 5*a* at an actuator element, superimposed in time on the measured pressure in an associated pressure chamber in response to the actual signal;

FIG. 5*c* graphically represents the result of driving a droplet deposition head with the waveform in FIG. 5*a;*

Figure 6A:
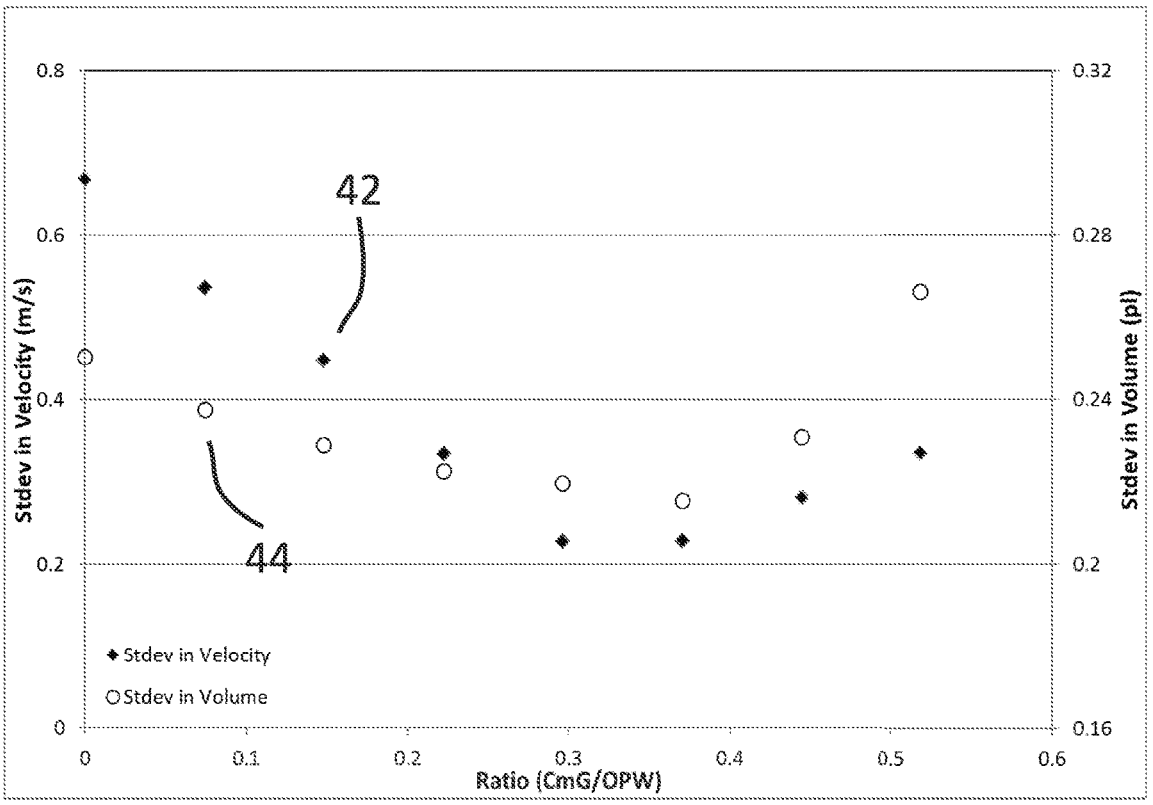
Figure 6B:
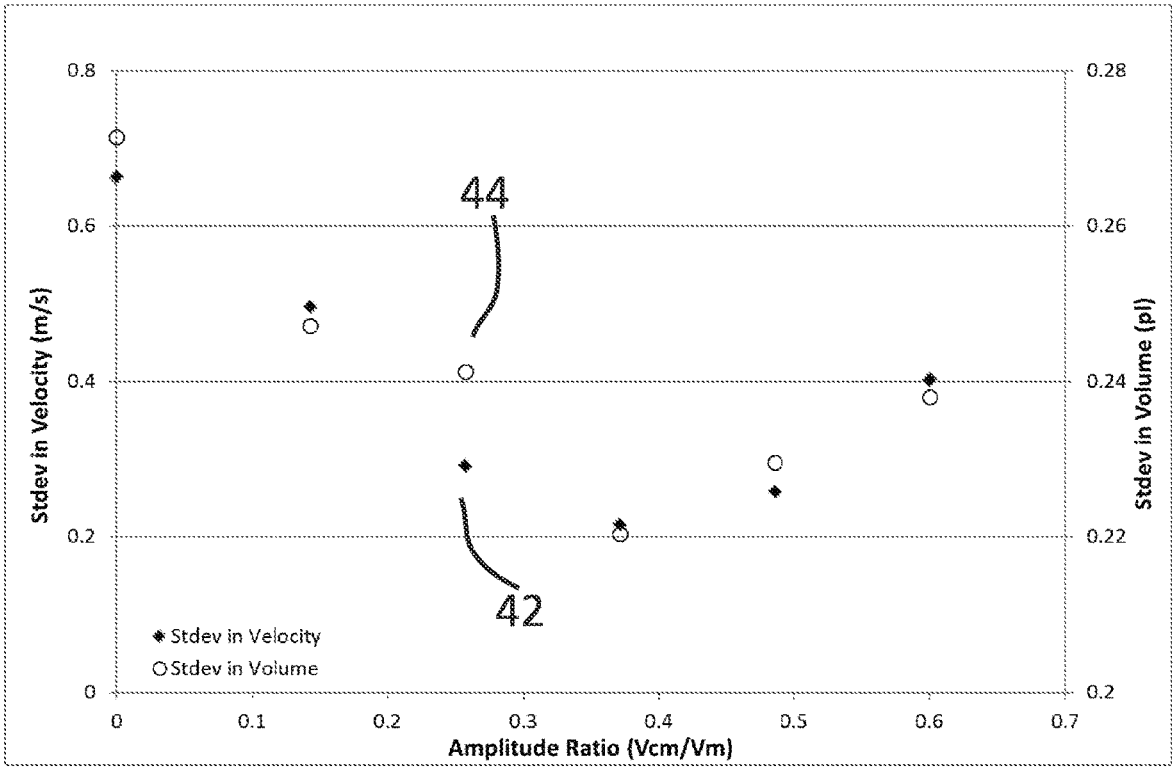
Figure 6C:
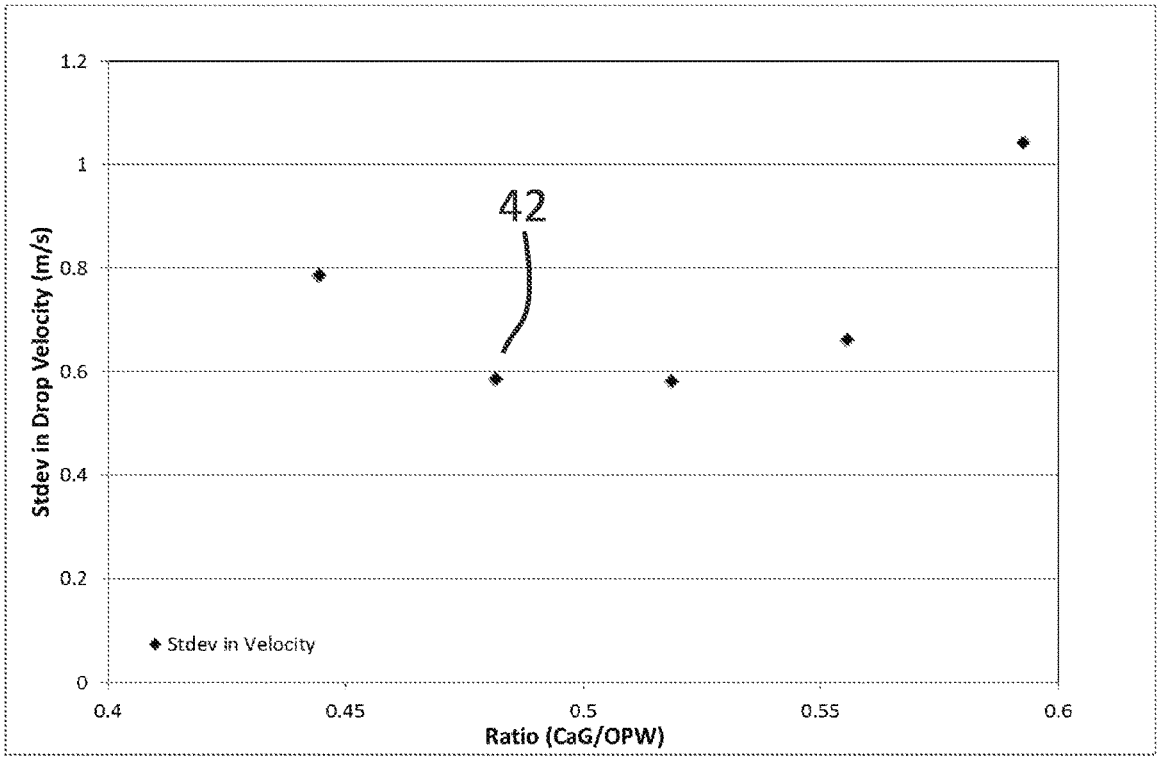
Figure 7:
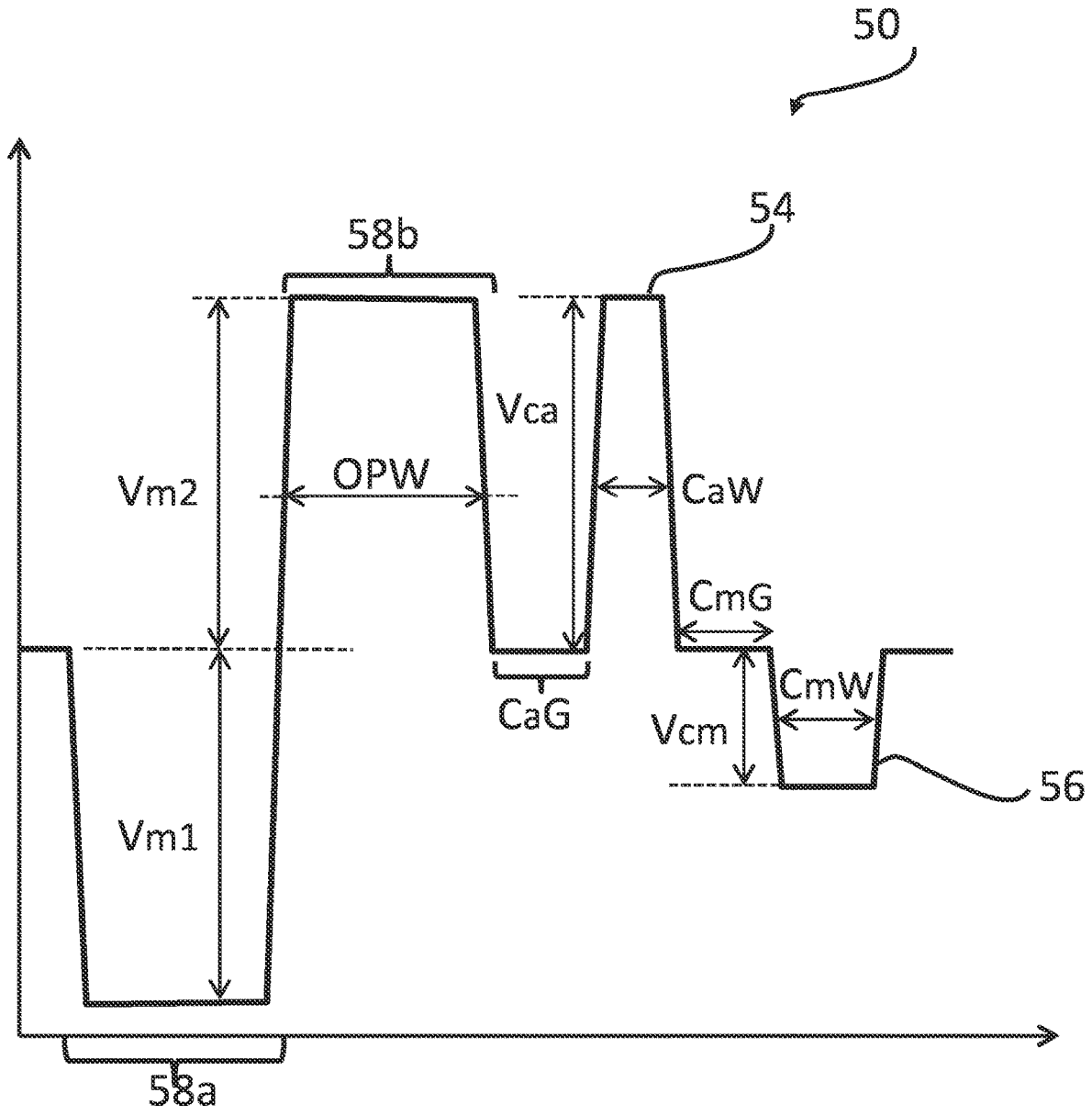
Figure 8A:
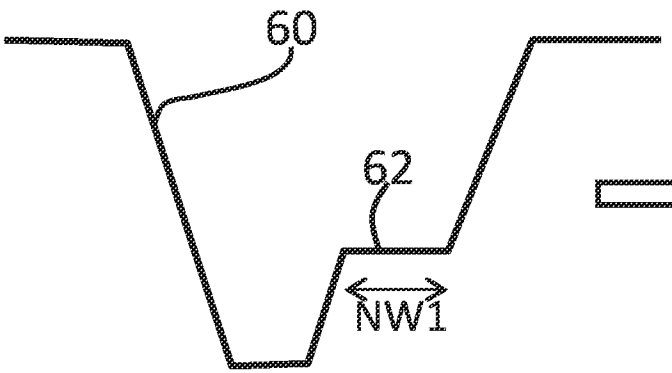
Figure 8B:
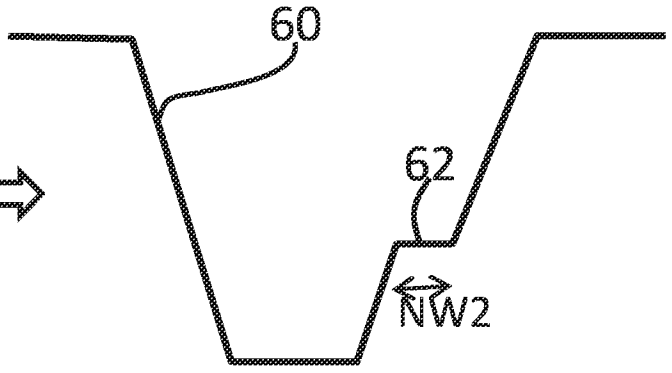
Figure 8C:
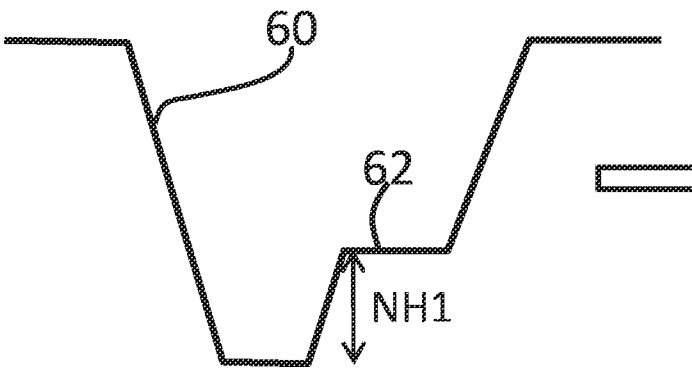
Figure 8D:
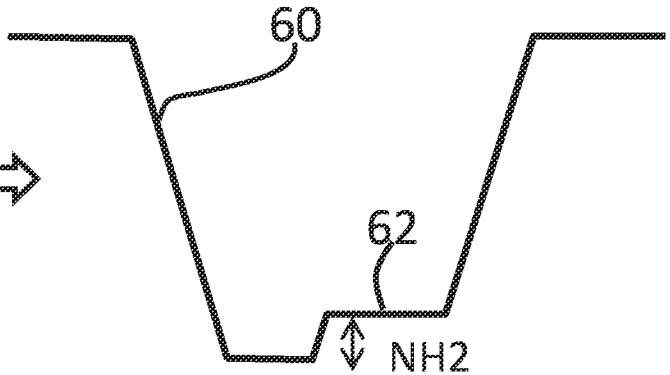
Figure 9:
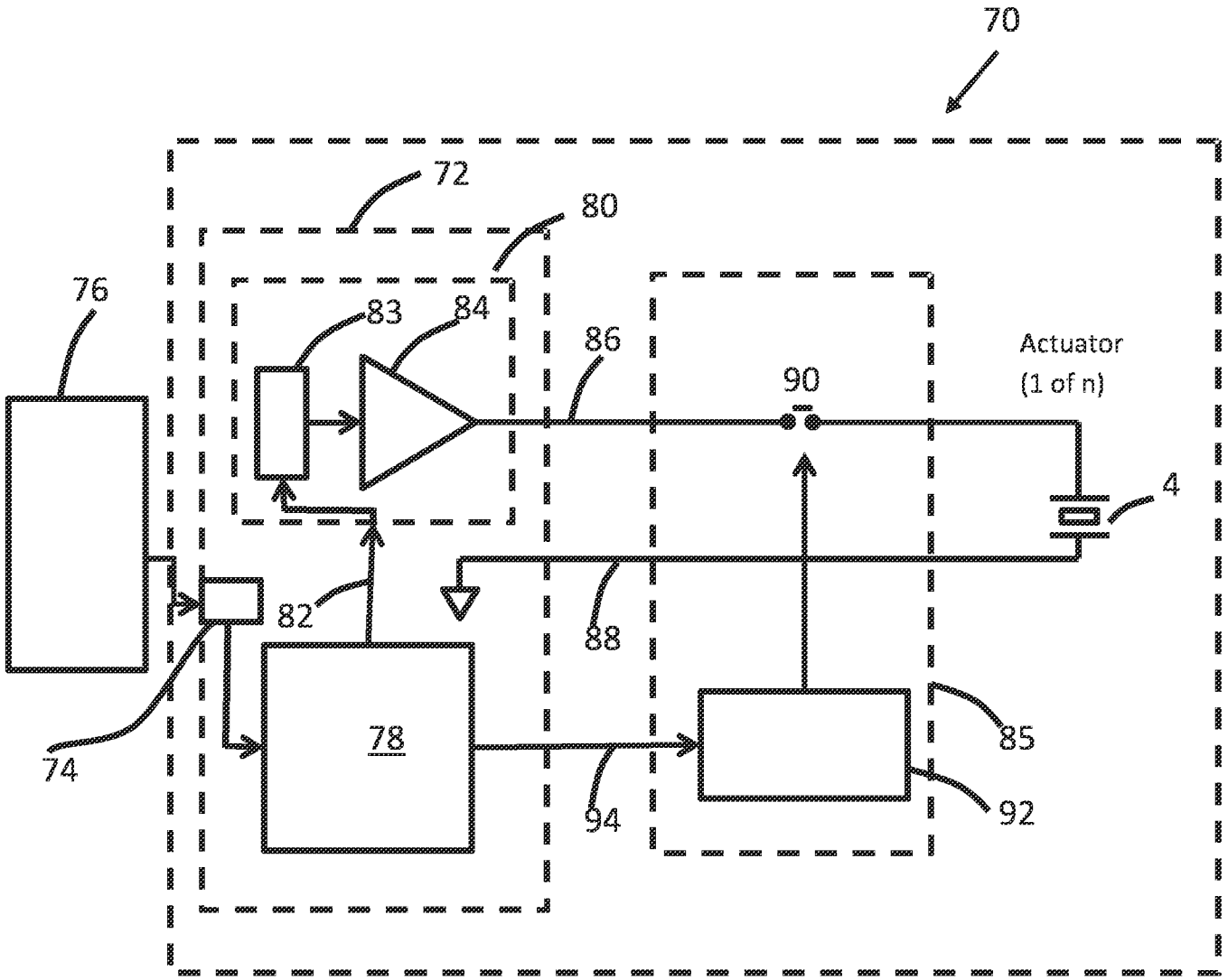

FIG. 6*a* graphically represents a standard deviation in frequency spectra for velocity and volume as a function of the delay between the cancellation pulse and the calming pulse in the drive waveform of FIG. 4;

FIG. 6*b* graphically represents a standard deviation in frequency spectra for velocity and volume as a function of the amplitude of the calming pulse and the drive pulse in the drive waveform of FIG. 4;

FIG. 6*c* graphically represents a standard deviation in frequency spectra for velocity as a function of the delay between the cancellation pulse and the drive pulse in the drive waveform of FIG. 4;

FIG. 7 schematically shows a drive waveform according to a further embodiment;

FIGS. 8*a*-8*d* schematically show a drive pulse according to a further embodiment; and FIG. 9 schematically shows an example of a droplet deposition apparatus having a circuit for generating a drive waveform according to an embodiment.

The present invention will be described with respect to particular embodiments and with reference to figures but note that the invention is not limited to features described, but only by the claims. The figures described are only schematic and are non-limiting examples. In the figures, the size of some of the elements may be exaggerated and not drawn to scale for illustrative purposes.

FIG. 1 schematically shows a cross section of part of a droplet deposition head 1 of a droplet deposition apparatus according to an embodiment.

The droplet deposition head 1 comprises at least one pressure chamber 2 having a membrane 3 with an actuator element 4 provided thereon to effect movement of the membrane 3 between a first position (depicted as P1), here shown as a neutral position, inwards into the pressure chamber to a second position (depicted as P2). It will also be understood that the actuator element could also be arranged to deflect the membrane in a direction from P1 opposite to that of P2 (i.e. outwards of the pressure chamber).

In the present examples, the actuator element 4 is depicted as being located on the membrane 3 forming a wall of the pressure chamber 2 that faces a nozzle 12 provided on a bottom wall of the pressure chamber 2 opposite the membrane 3. However, in other examples, the actuator element 4 may be arranged elsewhere within the pressure chamber 4 and in fluid communication with the nozzle, e.g. via a descender, or so as to form the side walls in a bulk piezoelectric actuator.

The pressure chamber 2 comprises a fluidic inlet port 14 for receiving fluid from a reservoir 16 arranged in fluidic communication with the pressure chamber 2.

The reservoir 16 is merely depicted adjacent the pressure chamber 2 for illustrative purposes. It could for example be provided further upstream, or remote from the droplet deposition head using a series of pumps/valves as appropriate.

The pressure chamber 2 optionally comprises a fluidic outlet port 18 for recycling any excess fluid in the pressure chamber 2 back to the reservoir 16 (or to another destination). In embodiments where the fluidic outlet port 18 is closed or no fluidic outlet port 18 is provided, then the fluidic inlet port 14 may merely replenish fluid that has been ejected from the pressure chamber 2 via the nozzle 12. In embodiments, the fluidic inlet port 14 and/or fluidic outlet port 18 may comprise a one-way valve.

In the present examples, the actuator element 4 is depicted as a piezoelectric actuator element 4 whereby a thin film of piezoelectric material 6 is provided between a first electrode 8 and a second electrode 10 such that applying an electric field across the actuator element 4 causes the actuator element 4 to charge, such that it experiences a strain and deforms. It will be understood that any suitable actuator element 4 may be used instead of a piezoelectric actuator element.

In the schematic example in FIG. 1, the pressure chamber 2 is arranged in what is commonly referred to as a "roof-mode" configuration, whereby deflection of the membrane 3 changes the volume, and, therefore the pressure, within the pressure chamber 2 such that droplets are ejected from the nozzle 12 due to the resulting pressure change.

Such deformation may be achieved by applying a drive waveform having one or more drive pulses to the actuator element 4 e.g. by selectively applying one or more drive pulses in the drive waveform to the first electrode 8, whilst maintaining the bottom electrode 10 at a reference potential such as ground potential.

The pressure change causes a pressure wave that reflects off the boundary structures, such as the bounding surfaces/walls of the pressure chamber, and causes residual pressure waves in the pressure chamber that are typically undesirable and impact the properties of subsequently ejected droplets, and therefore impact the achievable print quality of the droplet deposition apparatus.

The residual pressure waves may result in either constructive interference or destructive interference with pressure waves caused by following drive pulses, which may lead to a resulting droplet being ejected either faster or slower than it would otherwise be.

For example, constructive interference may increase the effective amplitude of a following drive pulse, thereby increasing droplet velocity of the resulting droplet, whilst destructive interference may decrease the effective amplitude of a following drive pulse thereby decreasing droplet velocity of the resulting droplet. The interference may also affect the drop volume of such droplets.

It will be understood that the droplet deposition head 1, and the associated features thereof (e.g. nozzle, actuator element, membrane, fluid ports etc.) may be fabricated using any suitable fabrication processes or techniques, such as, micro-electrical-mechanical systems (MEMS) processes.

Furthermore, whilst only one pressure chamber 2 is depicted in FIG. 1, it will be understood that any number of pressure chambers may be arranged in a suitable configuration. For example, the pressure chambers may be spaced along a linear array or may be staggered relative to each other.

FIG. 2*a* schematically shows an example of a known drive waveform 20 having a single drive pulse 22.

In FIG. 2*a*, the drive pulse 22 comprises an amplitude (Vm), having a first voltage level $V_{drive}$ fame and a second voltage level $V_{rest}$.

The drive pulse 22 comprises a falling portion whereby a leading edge falls from the drive voltage ($V_{drive}$) to the rest voltage ($V_{rest}$).

The drive pulse 22 also comprises a rising portion whereby, after a time period defined by the pulse width (PW), a trailing edge of the drive pulse 22 rises from $V_{rest}$ to $V_{drive}$.

The drive pulse 22 may be applied to one or more actuator elements, thereby deforming the membrane 3 sufficiently to draw fluid into the pressure chamber and to eject a droplet from a corresponding nozzle (not shown).

FIG. 2*b* (i)-(iii) schematically shows, by example only, the effect the drive pulse 22 has on membrane 3 when applied to an actuator element associated with the membrane 3.

For example, as shown at FIG. 2*b* (i), at $V_{drive}$, and before the leading edge, the membrane 3 is deformed. As the leading edge is applied, the membrane 3 changes from being in a deformed state to a state as defined by $V_{rest}$, thereby creating a negative pressure in the pressure chamber and drawing in fluid thereto.

In the present illustrative example as shown in FIG. 2*b* (ii), when $V_{rest}$ is applied, the actuator element is in a substantially neutral, non-actuated state. However, the actuator element may still display a degree of deformation due to strain.

At FIG. 2*b* (iii), at $V_{drive}$, the membrane 3 returns to being deformed such that the resulting positive pressure change causes a droplet to be ejected.

As will be understood by a person skilled in the art, by selectively applying one or more drive pulses 22 to actuator elements, the resulting droplets may be controlled to accurately land on a receiving medium (in conjunction with controlling a motion of a receiving medium, where necessary) within predetermined areas defined as pixels.

In a simple binary representation, each pixel will be filled with either one or no droplet. In a more developed representation, greyscale levels may be added by printing more than one droplet into each pixel to alter the perceived density of the image pixel. In this case, the droplets landing within the same pixel will generally be referred to as sub-droplets. Where ejected from the same nozzle, such sub-droplets may be ejected in rapid succession so as to merge or coalesce before landing on the receiving medium as one droplet of a volume that is the sum of all sub-droplet volumes. Once landed on the receiving medium, the droplet will in the following text be referred to as a 'dot'; this dot will have a colour density defined by the sum of all sub-droplet volumes.

The ejection of multiple sub-droplets to form a single dot having a particular greyscale level is well known and will not be explained in any detail here. For the purpose of describing the following embodiments and their examples, a greyscale level of 0, 1, 2, 3, . . . , n is intended to correspond to 0, 1, 2, 3, . . . , n ejected sub-droplets into the same pixel, where the volume of each sub-droplet contributes to the total volume landing in the pixel and therefore to the colour density of the resulting dot.

FIG. 3*a* schematically shows a representation of the drive waveform 20 when applied to an actuator element; FIG. 3*b* schematically shows the actual signal resulting from the drive waveform 20 at the actuator element (dashed line), superimposed in time on the measured pressure (solid line) in an associated pressure chamber in response to the actual signal; FIG. 3*c* graphically represents the result of driving a droplet deposition head with the waveform in FIG. 3*a* i.e. the droplet velocity (m/s) 26*a* and droplet volume (picolitres (pl)) 26*b* as a function of jetting frequency (kHz).

As shown in FIG. 3*b*, when the drive pulse 22 is applied to the actuator element, residual pressure waves exist in the pressure chamber until decaying to a level where interference with a subsequent pressure wave is minimised, which, for the present example, is taken to be below $\pm 100\times10^3$ Pa as illustratively shown at approximately 12.6 μs in FIG. 3*b*.

Therefore, to minimise the effects of the residual pressure waves on a following droplet, the period between consecutive drive pulses 22 in the waveform 20 may be increased to allow the residual pressure waves to decay sufficiently to avoid interference with pressure waves caused by a subsequent drive pulse 22.

However, as the print frequency is increased (as may be required for a particular application), the delay between consecutive drive pulses 22 is reduced whereby the residual pressure waves in the pressure chamber may not decay sufficiently to avoid interference, as is evident above approximately 30 kHz in the illustrative example of FIG. 3*c*, below which the droplet velocity (m/s) 26*a* and droplet volume (pl) 26*b* are substantially constant.

It will be understood that the achievable print quality of a particular nozzle may be measured against a number of parameters including, but not limited to droplet velocity and droplet volume. Therefore, the interference above approximately 30 kHz may negatively affect the achievable print quality of the droplet deposition apparatus.

In embodiments of the invention, additional non-ejection pulses are provided in the drive waveform and applied to an actuator element to reduce or minimise the residual pressure waves in the associated pressure chamber, whereby the additional non-ejection pulses reduce the effects of interference to achieve predictable and uniform droplet ejection properties, and therefore, to achieve improved print quality over a wider range of frequencies.

FIG. 4 schematically shows a drive waveform 30 having a drive pulse 32 and additional non-ejection pulses 34 and 36 according to an embodiment.

As above, the drive pulse 32 may be applied to an actuator element to generate one or more pressure waves which cause ejection of a droplet from an associated nozzle.

The first non-ejection pulse 34, hereinafter "cancellation pulse" is applied to the actuator element after the drive pulse to generate one or more pressure waves which destructively interfere with the residual pressure waves resulting from the drive pulse 32.

The second non-ejection pulse 36, hereinafter "calming pulse", is applied to the actuator element after the cancellation pulse to generate one or more pressure waves which destructively interfere with the residual pressure waves resulting from the drive pulse 32 and cancellation pulse 34, such that the residual pressure waves in the pressure chamber decay faster in comparison to when only the drive pulse is applied (as was described above and illustrated at FIGS. 2*a*-3*c* above).

Therefore, an improvement in printing at higher frequencies is achievable when applying a drive waveform comprising a drive pulse, a cancellation pulse and a calming pulse in comparison to only applying a drive waveform having a drive pulse.

In the present embodiment, the drive pulse 32 comprises an amplitude (Vm), having a first voltage level $V_{drive}$ fame and a second voltage level $V_{rest}$. The drive pulse 32 further comprises a pulse width (OPW).

The cancellation pulse 34 follows the drive pulse 32 in the drive waveform 30 after a delay (CaG) (where CaG≥0), the cancellation pulse 34 having an amplitude (Vca) and pulse width (CaW). In the present example, the cancellation pulse 34 is non-inverted with respect to the drive pulse 32.

The calming pulse 36 follows the cancellation pulse 34 in the drive waveform 30 after a delay (CmG) (where CmG≥0), the calming pulse 36 having an amplitude (Vcm) and pulse width (CmW). The calming pulse 36 is inverted with respect to the cancellation pulse 34, and, in the present embodiment, is inverted with respect to the drive pulse 32.

The characteristics of the drive waveform 30 can be varied to affect the generated droplets in different ways.

For example, parameter values of the respective pulse widths (OPW, CaW & CmW); respective amplitudes (Vm, Vca, &Vcm); and respective delays (CaG & CmG) associated with the different pulses may be varied to achieve different droplet velocities and droplet volumes.

In an embodiment the parameter values for the waveform, normalised against OPW, are substantially as follows:

OPW/HP (Helmholtz period of the pressure chamber) is substantially equal to (≈)0.5

CaG/OPW≈0.5;

CaW/OPW≈0.3;

CmG/OPW≈0.37;

CmW/OPW≈0.33;

Vca≈Vm; and

Vcm≈0.4 Vm

FIG. 5*a* schematically shows a representation of the drive waveform 30 when applied to an actuator element; FIG. 5*b* schematically shows the actual signal resulting from the drive waveform 30 at the actuator element (dashed line), superimposed in time on the measured pressure in an associated pressure chamber (solid line) in response to the actual signal; FIG. 5*c* graphically represents the result of driving a droplet deposition head with the waveform in FIG. 5*a*, i.e. the droplet velocity (m/s) 40*a* and droplet volume (pico-litres (pl)) 40*b* as a function of jetting frequency (kHz).

As shown in FIG. 5*b*, when a waveform comprising drive pulse 32, cancellation pulse 34 and calming pulse 36 is applied to the actuator element, residual pressure waves exist in the pressure chamber until decaying to below ±100 kPa as illustratively shown at approximately 7.8 μs in the waveform 38.

Therefore, the residual pressure waves in the pressure chamber decay faster when a drive pulse, cancellation pulse and calming pulse are applied to an actuator element in comparison to when only a drive pulse is applied.

Therefore, the delay between a calming pulse and a following drive pulse may be reduced in comparison to the delay required between consecutive drive pulses when a cancellation pulse and calming pulse are not applied which may provide for more uniform output at higher print frequencies, thereby providing improved print quality at higher print frequencies.

This is evident in the illustrative example of FIG. 5*c* whereby the droplet velocity 40*a* and droplet volume 40*b* are substantially constant up to approximately 120 kHz.

FIG. 6*a* graphically represents the standard deviation in the frequency spectra for droplet velocity 42 and droplet volume 44 as a function of the delay (CmG) between the cancellation pulse and calming pulse with respect to OPW (CmG/OPW); FIG. 6*b* graphically represents the standard deviation in the frequency spectra for droplet velocity 42 and droplet volume 44 as a function of the amplitude Vcm with respect to Vm (Vcm/Vm), FIG. 6*c* graphically represents a standard deviation in frequency spectra for velocity 42 as a function of the delay (CaG) between the cancellation pulse (CaW) and the drive pulse (OPW) in the drive waveform of FIG. 4.

For FIG. 6*a*, the parameter values of the drive waveform 30 as set out above in relation to FIG. 4 were maintained substantially constant but whereby CmG was swept/varied.

A preferable range for (CmG/OPW) is 0≤(CmG/OPW)≤0.55; and a more preferable range is 0.2≤(CmG/OPW)≤0.45; and an even further preferable range is 0.3≤(CmG/OPW)≤0.4.

For FIG. 6*b*, the parameter values of the drive waveform 30 as set out above in relation to FIG. 4 were maintained substantially constant but whereby Vcm was swept/varied.

A preferable range for (Vcm/Vm) is 0<(Vcm/Vm)≤0.65; and a more preferable range is 0.1≤(Vcm/Vm)≤0.55, and an even further preferable range is 0.25≤(Vcm/Vm)≤0.5.

For FIG. 6*c*, a preferable range for (CaG/OPW) is 0.44≤(CaG/OPW)≤0.59 and a more preferable range is 0.47≤(CaG/OPW)≤0.52, and an even further preferable range is 0.49≤(CaG/OPW)≤0.51.

In the embodiments above, the OPW≈0.5 HP. In other examples the optimum pulse width of the drive pulse is in the range 0.25≤OPW/HP≤0.75.

In the embodiments above, Vca≈Vm. However, in alternative embodiments the amplitude Vca may be increased or decreased with respect to Vm, and a preferable range is 0.65≤(Vca/Vm)≤1.35, and a more preferable range is 0.8≤(Vca/Vm)≤1.2, and a more preferable range is 0.9≤(Vca/Vm)≤1.1.

In the embodiments above, (CaW/OPW)≈0.3. However, in embodiments, a preferable range for (CmW/OPW) is 0.2≤(CaG/OPW)≤0.4.

In the embodiments above, (CmW/OPW)≈0.33. However, in other embodiments, a preferable range for (CmW/OPW) is 0.25≤(CmW/OPW)≤0.75, and a more preferable range is 0.3≤(CmW/OPW)≤0.6.

Outside of the identified preferable ranges, the frequency responses of the drop velocity and drop volume may be less favourable, although such frequency responses may be more preferable in comparison to applying a drive pulse in isolation.

The techniques described above, whereby a waveform comprising a drive pulse, cancellation pulse and calming pulse is applied to one or more actuator elements may be used across various types of droplet deposition apparatuses (e.g. roof-mode, shared-wall etc.), and provide improved print quality in comparison to when only drive pulses are applied to actuator elements.

The cancellation pulses and calming pulses reduce the pressure waves in the pressure chamber. It will be understood by a person skilled in that art that applying the cancellation pulse and calming pulse after a drive pulse may also reduce the impact of such pressure waves on neighbouring pressure chambers, thereby reducing the effects of cross-talk in the droplet deposition head.

Furthermore, and as described above, greyscale levels may be achieved by using two or more drive pulses to eject a corresponding sub-droplet whereby, in embodiments, the two or more drive pulses are followed by a cancellation pulse and a calming pulse.

In alternative embodiments, the drive waveform may comprise a drive pulse and a calming pulse, which is, as above, inverted with respect to the drive pulse and whereby the drive waveform does not include a cancellation pulse between the drive pulse and the calming pulse. Whilst such an embodiment may reduce the time it takes for pressures waves within the pressure chamber to decay, Vcm is required to be increased to achieve such a decay in comparison to when a cancellation pulse is provided between the drive pulse and calming pulse.

Furthermore, characteristics of the drive and non-ejection pulses may be modified. Such characteristics include but are not limited to: amplitude, pulse width, slew rates and/or intermediate voltages. For pulses such as trapezoidal shaped pulses having different slew rates, the pulse width may, for consistency, be measured at, for example, half the amplitude of the pulse.

Furthermore, drive pulses are not limited to the substantially square shape depicted in FIG. 2*a*, 3*a* and 5*a*, and any suitable shapes may be used to eject droplets as required. For example, trapezoidal, rectangular or sinusoid shaped (e.g. symmetric sinusoid) drive pulses may be used.

FIG. 7 shows a further illustrative example of a drive waveform 50 having a symmetric sinusoid drive pulse 52 and additional non-ejection pulses, such as cancellation pulse 54 and calming pulse 56 according to a further embodiment.

In FIG. 7 the symmetric sinusoid drive pulse 52 is in two parts, a first drive part 58*a* and a second drive part 58*b*. A delay (not shown) may be provided between the first drive part 58*a* and second drive part 58*b*. Furthermore, as previously described, the cancellation pulse 54 is inverted with respect to the calming pulse 56 to provide the advantages as previously described.

In the present embodiment, OPW is taken to be that of the second drive part 58*b*, whilst the amplitude Vca of the cancellation pulse is substantially equal to the amplitude $Vm_2$ of the second drive part 58*b*.

In further embodiments, the shape of the drive, cancellation and calming pulses may be modified so as to affect the characteristics of the droplets, pressure waves or the residual pressure waves.

For example, the pulses maybe "trimmed" to provide one or more ledges within the pulse so as to, for the drive pulses, generate droplets having certain characteristics or, for the non-ejection pulses, to affect the residual pressure waves within the pressure chamber.

As illustratively shown in FIGS. 8*a* to 8*d* which each depict a trapezoidal drive pulse 60, the trailing edge of the respective drive pulses 60 comprise a ledge portion 62.

In embodiments, the length of the ledge portion 62 may be modified as required by a specific application (e.g. as depicted by NW1 and NW2 in FIGS. 8*a* and 8*b* respectively). Additionally, or alternatively, the height of the ledge portion 62 may be modified as required by a specific application (e.g. as depicted by NH1 and NH2 in FIGS. 8*c* and 8*d* respectively).

It will be understood that a ledge may additionally or alternatively be provided on the leading edge of the drive pulse 62.

Similar modifications may be provided on the non-ejection pulses so as to trim those pulses. For example, a drive pulse and the cancellation pulse may be independently trimmed so that the effective amplitudes match or do not match. The peak voltage for trimmed drive pulses may not match the peak voltage of the trimmed cancellation pulse yet have the same result as if the peak voltages were equal.

The drive waveform may be generated using any suitable circuitry. In some embodiments the drive circuit may generate a common drive waveform which is selectively applied to one or more actuator elements.

In alternative embodiments the drive circuit may generate a drive waveform per actuator element.

FIG. 9 schematically shows an example of a droplet deposition apparatus 70 having circuitry for generating a drive waveform having a drive pulse, a first non-ejection pulse and a second non-ejection pulse, wherein the drive waveform is selectively applied to one or more actuator elements.

As above, the droplet deposition apparatus 70 may comprise a plurality of 'n' actuator elements 4 (where 'n' is an integer), for ejecting droplets in a controlled manner from nozzles associated therewith. For the purposes of clarity, only one actuator element 4 is schematically shown in FIG. 9.

In the present illustrative example, the droplet deposition apparatus has a system circuit 72 which includes communication circuitry 74 for transmitting/receiving communications to/from one or more external sources 76, depicted as a host computer in FIG. 9.

The system circuit 72 further comprises a system control unit 78, which comprises processing logic to process data (e.g. image data, programs, instructions received from a user etc.) and generate output signals in response to the processed data. The system control unit 78 may comprise any suitable circuitry or logic, and may, for example, be a field programmable gate array (FPGA), system on chip device, microprocessor, microcontroller or one or more integrated circuits.

In the present embodiment, image data sent from the host computer 76 is received at the system control unit 78 and processed thereat. The image data relates to the desired characteristics of a printed dot to be created within a pixel on a receiving medium (e.g. pixel position, density, colour etc.), where the pixel defines a specific position within a rasterised version of the image. As such the image data may define the characteristics of the droplets required to be ejected from a particular nozzle to create the dot in the pixel.

The system circuit 72 includes drive circuit 80 configured to generate a drive waveform having a drive pulse, a first non-ejection pulse and a second non-ejection pulse wherein the first non-ejection pulse is inverted with respect to the second non-ejection pulse.

In the present illustrative example, the drive circuit 80 generates the drive waveform in response to a waveform-control signal 82 from the control unit 78, whereby the waveform-control signal 82 comprises a logic output which is fed to a digital-to-analog converter (DAC) 83, whereby an analog output from the DAC 83 is fed to an amplifier 84 for generating the drive waveform.

In the present embodiment the control unit 78 generates the waveform-control signal 82 in response to, for example, the image data, programs, instructions received from a user etc., whereby the waveform-control signal 82 defines the characteristics of the drive waveform and the pulses thereof (e.g. shapes, amplitudes, pulse widths, delays between pulses etc.).

The drive waveform is transmitted to head-drive circuit 85, along one or more transmission paths 86 so as to be selectively applied to the one or more actuator elements 4. The one or more actuator elements 4 are also connected to one or more return paths 88.

In some examples a common drive waveform may be transmitted to be applied to one or more actuator elements. In alternative embodiments, individual drive waveforms may be transmitted to each of the actuator elements.

In the illustrative example of FIG. 9, head-drive circuit 85 comprises an application specific integrated circuit (ASIC), which includes switch logic 90 associated with the one or more actuator elements 4. The switch logic 90 is configured to, dependent on the state thereof, pass the drive waveform therethrough in a controllable manner such that the drive waveform can be selectively applied to an associated actuator element 4.

For example, the switch-logic 90 may be in a closed state to allow the drive waveform to pass therethrough to be applied to the associated actuator element 4, or the switch logic 90 may be in an open state to prevent the drive waveform passing therethrough.

In examples the switch logic 90 may comprise one or more transistors arranged in a suitable configuration, such as a pass gate configuration.

In the present example, the state of the switch logic 90 is controllable by a switch logic-control unit 92 in response to a pixel control signal 94 received from the system control unit 78, whereby the pixel-control signal 94 comprises data defining when the switch logic control unit 92 should control the state of the switch logic 90 so as to apply the drive waveform to the respective actuator elements 4.

It will be understood that the example described in FIG. 9 is an illustrative example of circuitry for generating one or more drive waveforms having a drive pulse, a first non-ejection pulse and a second non-ejection pulse, wherein the first non-ejection pulse is inverted with respect to the second non-ejection pulse. However, any suitable circuitry may be used to generate such drive waveforms.

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

In a further alternative, the preferred embodiment of the present techniques may be realized in the form of a data carrier having functional data thereon, said functional data comprising functional computer data structures to, when loaded into a computer system or network and operated upon thereby, enable said computer system to perform all the steps of the method.

It will be clear to one skilled in the art that many improvements and modifications can be made to the foregoing exemplary embodiments without departing from the scope of the present techniques.

The invention claimed is:

1. A circuit for a droplet deposition apparatus configured to execute operations comprising:

generating a drive pulse for driving the droplet deposition apparatus to cause ejection of a droplet, generating a first non-ejection pulse which does not cause deposition by the droplet deposition apparatus; and generating a second non-ejection pulse which does not cause deposition by the droplet deposition apparatus, wherein the first non-ejection pulse is inverted with respect to the second non-ejection pulse, and the operations further comprise generating a first delay between the first non-ejection pulse and the second non-ejection pulse.

2. The circuit according to claim 1, wherein the first non-ejection pulse is non-inverted with respect to the drive pulse; and the second non-ejection pulse is inverted with respect to the drive pulse.

3. The circuit according to claim 1, wherein the first delay is selected as a function of a first pulse width of the drive pulse.

4. The circuit according to claim 3, wherein the operations further comprise generating a second delay between the drive pulse and the first non-ejection pulse.

5. The circuit according to claim 4, wherein the second delay is selected as a function of the first pulse width.

6. The circuit according to claim 5, wherein the second delay is in a range that satisfies 0.44≤(the second delay/the first pulse width)≤0.59.

7. The circuit according to claim 3, wherein the circuit is coupled to a pressure chamber; and the first pulse width is in a range that satisfies 0.25≤(the first pulse width/Helmholtz period of the pressure chamber)≤0.75.

8. The circuit according to claim 3, wherein the first delay is in a range that satisfies 0≤(the first delay/the first pulse width)≤0.55.

9. The circuit according to claim 3, wherein the first non-ejection pulse comprises a second pulse width; and the second non-ejection pulse comprises a third pulse width.

10. The circuit according to claim 9, wherein the second pulse width is in a range that satisfies 0.20≤(the second pulse width/the first pulse width)≤0.40.

11. The circuit according to claim 9, wherein the third pulse width is in a range that satisfies 0.25≤(the third pulse width/the first pulse width)≤0.6.

12. The circuit according claim 1, wherein the drive pulse comprises a first amplitude; and the first non-ejection pulse comprises a second amplitude.

13. The circuit according to claim 12, wherein the first amplitude is substantially equal to the second amplitude.

14. The circuit according to claim 12, wherein the second amplitude is in a range that satisfies 0.65≤(the second amplitude/the first amplitude)≤1.35.

15. The circuit according to claim 12, wherein the second non-ejection pulse comprises a third amplitude, and the third amplitude is in a range that satisfies 0<(the third amplitude/the first amplitude)≤0.65.

16. The circuit according to claim 1, wherein the operations further comprise generating two or more drive pulses arranged to generate sub-droplets when applied to an actuator element.

17. The circuit according to claim 1, wherein at least one of the drive pulse, the first non-ejection pulse, or the second non-ejection pulse are trimmed.

18. The circuit according claim 1, wherein the drive pulse is applied to an actuator element to generate a first pressure wave in a pressure chamber to cause ejection of a droplet;

the first non-ejection pulse is applied to the actuator element to generate a second pressure wave in the pressure chamber, the second pressure wave being configured to destructively interfere with the first pressure wave; and the second non-ejection pulse is applied to the actuator element to generate a third pressure wave in the pressure chamber, the third pressure wave being configured to destructively interfere with at least one of the first pressure wave or the second pressure wave.

19. A droplet deposition apparatus comprising:

a droplet deposition head comprising:

one or more actuator elements configured to eject droplets from a pressure chamber in response to a drive waveform applied thereto; and a circuit configured to generate the drive waveform, the drive waveform comprising:

a drive pulse for driving the droplet deposition apparatus to cause ejection of a droplet;

a first non-ejection pulse which does not cause deposition by the droplet deposition apparatus; and a second non-ejection pulse which does not cause deposition by the droplet deposition apparatus, wherein the first non-ejection pulse is inverted with respect to the second non-ejection pulse, and the drive waveform comprises a first delay between the first non-ejection pulse and the second non-ejection pulse.

20. A computer-implemented method for driving an actuator element with a drive waveform to eject droplets from a pressure chamber, the method comprising:

applying a drive pulse to the actuator element, wherein the drive pulse drives the actuator element to cause ejection of a droplet;

applying a first non-ejection pulse to the actuator element, wherein the first non-ejection pulse does not cause droplet deposition by the actuator element; and applying a second non-ejection pulse to the actuator element, wherein the second non-ejection pulse does not cause droplet deposition by the actuator element, wherein the second non-ejection pulse is inverted with respect to the first non-ejection pulse, and the drive waveform comprises a first delay between the first non-ejection pulse and the second non-ejection pulse.

* * * * *